United States Patent [19]

Nonnenmacher et al.

[11] 4,185,540

[45] Jan. 29, 1980

[54] POSITIVE-DISPLACEMENT MACHINE

[75] Inventors: Gerhard Nonnenmacher, Korntal; Walter Robeller, Boeblingen; Karl Veil, Uhingen; Roland Steimann, Stuttgart, all of Fed. Rep. of Germany

[73] Assignee: Robert Bosch GmbH, Stuttgart, Fed. Rep. of Germany

[21] Appl. No.: 895,125

[22] Filed: Apr. 10, 1978

[30] Foreign Application Priority Data

May 6, 1977 [DE] Fed. Rep. of Germany ..... 2720306

[51] Int. Cl.[2] ..... F04B 13/06

[52] U.S. Cl. ..... 91/497; 417/221

[58] Field of Search ..... 91/497; 417/218, 221; 92/85 B

[56] References Cited

U.S. PATENT DOCUMENTS

| | | | |
|---|---|---|---|
| 2,603,952 | 7/1952 | Dodge | 92/75 |
| 3,809,500 | 5/1974 | Staudenrausch | 417/222 |
| 3,921,503 | 11/1975 | Kubik | 417/218 |
| 4,077,745 | 3/1978 | Romefsch | 417/221 |

FOREIGN PATENT DOCUMENTS

| | | | |
|---|---|---|---|
| 714881 | 8/1965 | Canada | 92/85 B |
| 2419466 | 11/1975 | Fed. Rep. of Germany | 417/218 |
| 1388002 | 3/1975 | United Kingdom | 417/218 |

*Primary Examiner*—William L. Freeh
*Attorney, Agent, or Firm*—Michael J. Striker

[57] ABSTRACT

A positive-displacement machine includes a hollow housing provided with two diametrically opposed bores each having a first end communicating with an interior of the housing and a second end closed by a cover. A rotor member is adjustably displaceable in the interior of the housing due to displacement of two pistons positioned in the bores. The pistons are connected to a high pressure chamber, to thereby create in the pistons pressure sufficient to move the latter, to thereby move the rotor member. The housing is provided with control devices to change the pressure in the bores and create a pressure differential in the bores sufficient to move the rotor member into a predetermined position.

14 Claims, 2 Drawing Figures

POSITIVE-DISPLACEMENT MACHINE

BACKGROUND OF THE INVENTION

The present invention relates to positive-displacement machines. More particularly, this invention concerns a piston-displacement pump.

Positive-displacement machines are already well known and they usually include a hollow housing provided with an adjustable working element positioned in the housing between slidably mounted pistons of different cross-sections. The piston of relatively large cross-section is connected through a control device with a high-pressure chamber, to thereby regulate the position of the adjustable element.

Forces exercised on the adjustable element due to displacement of a workpiece create a fluctuating internal force applied on the adjustable element. This counteracting force must be taken up by the pistons.

Should the force operate in the direction towards the relatively large piston, then in order to achieve force-equilibrium, the pressure in the bore which receives the piston will rise. The rising of the pressure in this bore occurs due to compression of pressure fluid contained in the bore.

The adjustable element then moves towards this piston. Should the force change its direction towards the relatively small piston, then in order to achieve force-equilibrium, the pressure in the relatively large bore is reduced due to the expansion of the bore volume as the adjustable element moves towards the relatively small piston.

Such displacements make the adjustable elements oscillate between the pistons, which oscillation leads to noise due to air-body excitation in the housing.

SUMMARY OF THE INVENTION

It is a general object of the present invention to avoid the disadvantages of the prior art positive-displacement machines.

More particularly, it is an object of the present invention to provide a positive-displacement machine wherein the amplitude of oscillation of the adjustable element is reduced to thereby minimize noise in the positive displacement machine.

In pursuance of this object and others, which will become apparent hereafter, one feature of the present invention resides in providing a positive-displacement machine comprising a housing having a hollow chamber and two diametrically opposed bores each having a first end communicating with the chamber and a second end closed by a cover. There is a rotor member positioned in the hollow chamber, which rotor member is adjustably displaceable in the space between the first ends of the bores. In the bores there are slidably mounted means cooperating with said rotor member for displacing the latter in the space between the first ends of the bores.

In accordance with another feature of this invention, the machine is provided with means for producing in the bores a pressure differential sufficient to displace the rotor member.

In order to increase the stiffness of engagement of the rotor member by the piston during its displacement in the space between trailing ends of the pistons, the device according to the present invention is provided with means in at least one of the bores and connected to the displacing means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
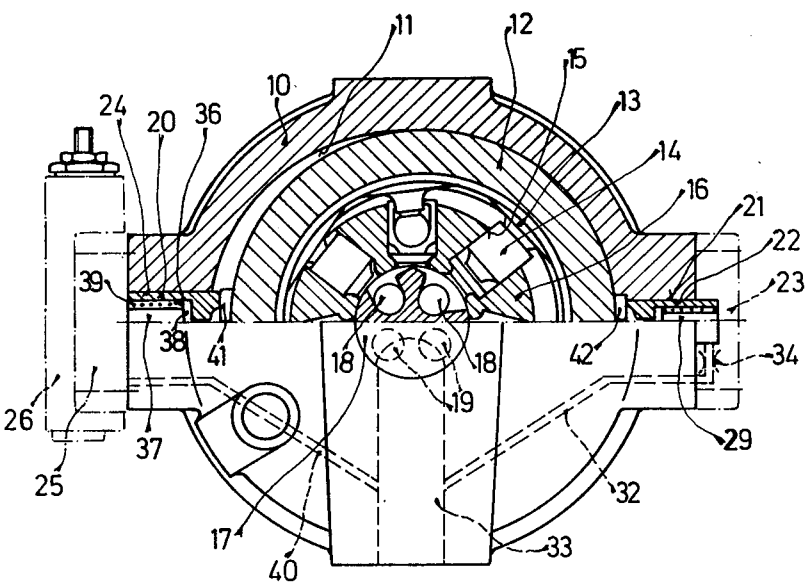
FIG. 1 is a partial cross-section through a radial piston pump according to the present invention.

Referring now to the drawings and first to FIG. 1 thereof, it may be seen that the reference numeral 10 is used to designate a housing of a radial-piston machine. The housing 10 has an oval interior in which a working ring 12 is displaceably positioned. The internal side of the ring 12 serves as a support for slippers 13 of pistons 14. The pistons 14 are closely slidably received in holes 15 provided in a rotor 16. The rotor 16 is rotatably mounted on a control journal 17. The journal 17 is fixed on the housing 10 and is provided with longitudinal bores 18 and 19 for admitting and discharging the pressure medium.

The working ring 12 is displaceable in the interior space 11 of the housing 10. The displacement occurs due to a regulating piston 20 and a counter piston 21. The pistons operate on diametrically opposed sides of the outer periphery of the ring 12. The diameter of the regulating piston 20 exceeds that of the counter piston 21. The piston 21 is slidably displaceable in a bore 22 provided on the housing 10. The bore 22 is closed at its other end with a cover 23. The regulating piston 20 is slidably displaceable in a bore 24, which is closed at its outer end with a cover 25, on which a control device 26 is positioned.

Figure 2:
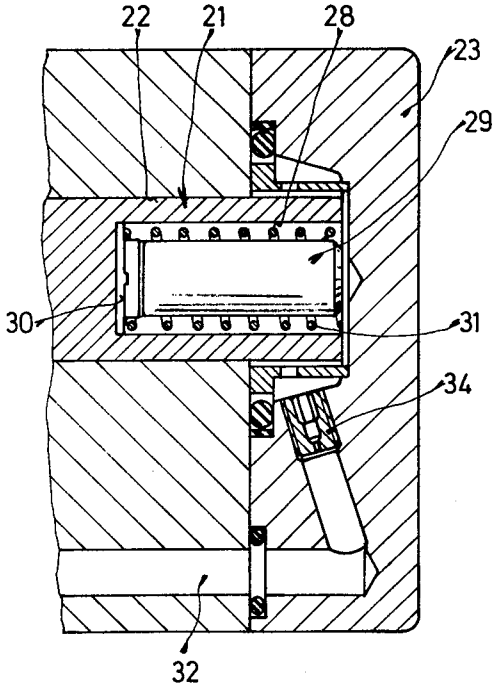
FIG. 2 is an enlarged sectional view of a portion of the device shown in FIG. 1.

FIG. 2 shows an enlarged view of an organization of the counter piston 21. The features which are not important for the present invention have not been shown in FIG. 2 in detail. The counter piston 21 is provided with a blind hole 28, which has an open end towards the cover 23. The blind hole 28 is provided with an intermediate body 29. The body 29 is formed with a collar 30, which abuts the closed end of the blind hole. A spring 31 is positioned on the body 29 and abuts the collar 30, and the other end of it is positioned on the cover 23. The spring is positioned in a narrow gap between the body 29 and the wall of the blind hole 28, so as to normally urge the piston 21 with a relatively small force towards the working ring 12.

The bore 22 communicates with a passage 32, which terminates in a high pressure bore 33 of the machine. The passage 32 extends through the cover 23 and is provided with a throttle 34, which can be a constant throttle or an adjustable one.

The regulating piston 20 is similarly configurated. It has a blind hole 26 in which an intermediate body 37 is placed. The collar 38 of the body 37 abuts a closed end of the hole. A spring 39 is positioned with its one end on the collar 38 and with the other end on the cover 25. A passage 40 leads from the high pressure bore 33 to a control device 26, which is connected to the regulating piston 20. The control device 26 is operative to change the pressure in the bore 24 according to the desired position of the ring 12. A similar precaution is known in the prior art. As shown in FIG. 1, the pistons 20 and 21 operate on the ring 12 not directly, but through intermediate bodies 41 and 42, respectively.

In practice, the positive-displacement machine—whether it is a pump or a motor—applies the high pressure constantly on the counter piston 21 through the passage 32. The working ring 12 moves towards the regulating piston 20, if the pressure in the bore 24 is released by way of the control device 26. If the regulating piston is connected to the high pressure bore 33 through the device 26 and passage 40, then the ring 12 moves in opposite direction, because the working surface of the regulating piston is substantially bigger than that of the counter piston 22.

Should the ring 12 move towards counter piston 21 due to the internal forces created by the pistons 14, then the pressure on the throttle 34 will rise due to the pressure medium coming out of the bore 22. Subsequently, the counterforce of the piston 21 and the ring 12 will rise so as to diminish the displacement of the ring 12.

In the bores 22 and 24 which accommodate the pistons 20 and 21, there are formed so called "hydraulic springs," whose spring stiffness determines the rigidity of the clamping action operating upon the working ring 12.

By placing the intermediate bodies 29 and 37 of solid material in the recesses in the pistons 21 and 20, the modulus of elasticity of the pistons is heightened, comparative than that of oil. Therefore, the spring stiffness and the rigidity of the ring 12 is also heightened. Due to this fact, the amplitude of oscillation of the ring, owing to the central forces applied to the ring, is decreased thanks to the heightened stiffness of hydraulic clamping action of the ring 12 between both pistons.

Change of pressure in the bore 21 depends on the cross-section of the throttle 34, as well as on the rate of regulating the position of the ring 12. By using an adjustable throttle 34 it becomes possible to show such a regulation for the position of the ring so as to minimize the noise of the machine.

It will be understood that each the elements described above, or two or more together, may also find a useful application in other types of a positive-displacement hydraulic machine differing from the types described above.

While the invention has been illustrated and and described as embodied in a positive-displacement hydraulic machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A positive-displacement machine, comprising a housing having a hollow chamber and two diametrically opposed bores each having a first end communicating with said chamber and a second end; closing means for closing said second end of each of said bores; a rotor member positioned in said hollow chamber and adjustably displaceable in the space between said first ends of said bores; means slidably movable in said bores and cooperating with said rotor member for displacing said rotor member in said space, said displacing means comprising a liquid-operated regulating piston slidable in one of said bores and a liquid-operated counter piston slidable in the other of said bores, each of said pistons having a leading end with a working surface communicating with said chamber and a trailing end with an exposed surface facing outwardly of said bore; a high pressure chamber in said housing operatively connected to both of said bores to create therein a pressure sufficient to move said displacing means; means for varying the pressure in at least one of said bores and operative for producing in said bores a pressure differential between the pressure in said bores sufficient to displace said rotor member into a predetermined position; and means in at least one of said bores and connected to said displacing means and operative for increasing the rigidity of the latter, to thereby also increase the stiffness with which said rotor member is engaged by said slidable means during displacement in said space.

2. A machine as defined in claim 1, wherein the cross-section of said regulating piston exceeds that of said counter piston.

3. A machine as defined in claim 1, wherein said closing means comprise two covers each provided with a recess corresponding to said bore in the housing and sufficient to receive said trailing end of said pistons during sliding the latter in the bores.

4. A machine as defined in claim 3, wherein each of said pistons is provided at the trailing end with a blind hole having an open end and a closed end and operative for receiving from the open end said means for increasing the rigidity of the displacing means.

5. A machine as defined in claim 4, wherein said means for increasing the rigidity of the displacing means comprise an intermediate body in said blind hole, said body having one end abutting the closed end of said blind hole and the other end being substantially flush with the exposed surface of the trailing end of the piston.

6. A machine as defined in claim 4, wherein said means for increasing the rigidity of the displacing means further comprise a spring placed on said intermediate body and abutting said closed end of the blind hole provided in the piston to thereby normally urging said piston into communication with said chamber.

7. A machine as defined in claim 6, wherein said intermediate body is of solid material.

8. A machine as defined in claim 3, wherein said covers are further provided with a first passage means having an outlet communicating with said recess and an inlet, and said housing is further provided with a second passage means having an inlet communicating with said high pressure chamber and an outlet communicating with said inlet of the first passage means to thereby create a throughgoing passage from said high pressure chamber to said recess in the cover.

9. A machine as defined in claim 8, wherein said varying means comprise a first pressure control device positioned in the passage means connecting said regulating piston with the high pressure chamber.

10. A machine as defined in claim 9, wherein said varying means further comprise a second control device positioned in the passage means connecting said counter piston with the high pressure chamber.

11. A machine as defined in claim 10, wherein said second control device is a throttle.

12. A machine as defined in claim 10, wherein said second control device is an adjustable throttle.

13. A positive-displacement machine, comprising a housing having a hollow chamber and two diametrically opposed bores each having a first end communicating with said chamber and a second end; a rotor member positioned in said hollow chamber and ajustably displaceable in the space between said first ends of said bores; means slidably movable in said bores and cooperating with said rotor member for displacing the latter in said space, and including a liquid-operated regulating piston slidable in one of said bores and a liquid-operated counter piston slidable in the other of said bores, each of said pistons having a leading end with a working surface communicating with said chamber and a trailing end with an exposed surface facing outwardly of said bore, each of said pistons being provided at the trailing end with a blind hole having an open end and a closed end; closing means for closing said second end of each of said bores, and including two covers each provided with a recess corresponding to said bore in the housing and sufficient to receive said trailing end of said pistons during sliding the latter in the bores; a high pressure chamber in said housing operatively connected to both of said bores to create therein a pressure sufficient to move said displacing means; means for varying the pressure in at least one of said bores and operative for producing in said bores a pressure differential between the pressure in said bores sufficient to displace said rotar member into a predetermined position; and means in at least one of said bores and received in the respective blind hole, from the respective open end thereof, and connected to said displacing means and operative for increasing the rigidity of the latter, to thereby also increase the stiffness with which said rotor member is engaged by said slidable means during displacement in said space, said means for increasing the rigidity of the displacing means comprising an intermediate body in said respective blind hole, said body having one end abutting the respective closed end of said blind hole and the other end being substantially flush with the exposed surface of the trailing end of the piston.

14. A pisitive-displacing machine, comprising a housing having a hollow chamber and two diametrically opposed bores each having a first end communicating with said chamber and a second end; closing means for closing said second end of each of said bores; a rotor member positioned in said hollow chamber and adjustably displaceable in the space between said first ends of said bores; means slidably movable in said bores and cooperating with said rotor member for displacing the latter in said space, and including a liquid-operated regulating piston slidable in one of said bores and a liquid-operated counter piston slidable in the other of said bores, each of said pistons having a leading end communicating with said chamber and a trailing end facing away from said chamber, and being provided at the trailing end with a blind hole having an open end and a closed end; a high pressure chamber in said housing operatively connected to both of said bores to create therein a pressure sufficient to move said displacing means; means for varying the pressure in at least one of said bores sufficiently to displace said rotor member into a predetermined position; and means received in at least one of said blind holes, and connected to said displacing means and operative for increasing the rigidity of the latter, and including at least one intermediate body installed in said one of said blind holes, to thereby increase the stiffness with which said rotor member is engaged by said slidable means during displacement in said space.

* * * * *